United States Patent [19]

Cameron

[11] 4,130,499

[45] Dec. 19, 1978

[54] CORK CLEANING FORMULA

[76] Inventor: Vernon T. Cameron, 1500 Marquette Ave., South Milwaukee, Wis. 53172

[21] Appl. No.: 824,491

[22] Filed: Aug. 15, 1977

[51] Int. Cl.[2] ..... C11D 3/02; C11D 3/10; C11D 3/43; C11D 17/08

[52] U.S. Cl. ..... 252/153; 252/89 R; 252/173; 252/541; 252/558; 252/DIG. 14

[58] Field of Search ..... 427/140; 252/89, 111, 252/118, 153, 173, 541, 558, 139, DIG. 14

[56] References Cited

U.S. PATENT DOCUMENTS

| | | | |
|---|---|---|---|
| 3,001,947 | 9/1961 | Stahler | 252/118 |
| 3,342,740 | 9/1967 | Kazmierczak | 252/153 |
| 3,679,609 | 7/1972 | Castner | 252/527 |
| 3,694,365 | 9/1972 | Castner | 252/106 |

FOREIGN PATENT DOCUMENTS

| | | | |
|---|---|---|---|
| 149728 | 8/1920 | United Kingdom | 252/118 |

*Primary Examiner*—Dennis L. Albrecht
*Attorney, Agent, or Firm*—Daniel J. Tick

[57] ABSTRACT

A formula includes a detergent, water, alcohol, ammonia and sodium carbonate. The formula, when applied to the cork handle of a fishing rod, restores the handle to a new velvety finish.

3 Claims, 1 Drawing Figure

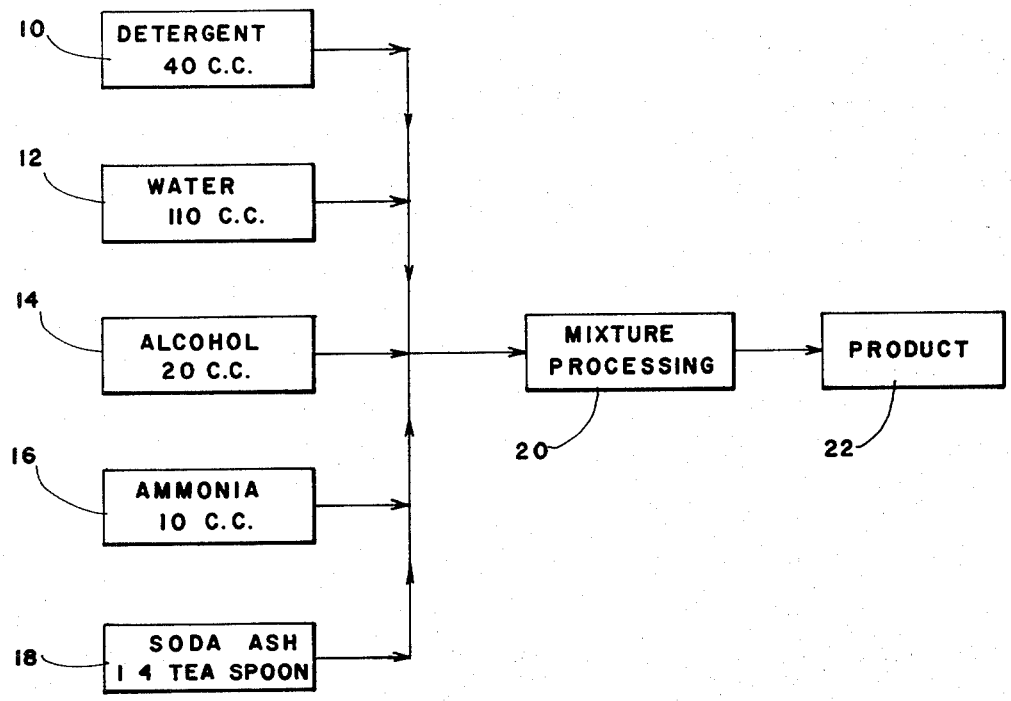
10
DETERGENT
40 C.C.
12
WATER
110 C.C.
14
ALCOHOL
20 C.C.
16
AMMONIA
10 C.C.
18
SODA ASH
1 4 TEA SPOON
MIXTURE
PROCESSING
20
PRODUCT
22

CORK CLEANING FORMULA

BACKGROUND OF THE INVENTION

The present invention relates to a cleaning formula. More particularly, the invention relates to a cork cleaning formula for fishing rod handles.

The cleaning formula of the invention, when used on the cork handles of fishing rods, produces a velvety finish like the original new finish on the handles.

The ingredients of the cleaning formula of the invention for the cleaning of cork, include sodium carbonate or soda ash, a surfactant or detergent such as, for example, plurafac RA40 and rubbing alcohol. Other detergents or surfactants which may be utilized are alkyl benzene sulfonate and sodium dodecyl benzene sulfonate.

BRIEF DESCRIPTION OF THE DRAWING

In order that the invention may be readily carried into effect, it will now be described with reference to the accompanying drawing, wherein the single FIGURE is a flow chart of the cleaning formula of the invention.

DETAILED DESCRIPTION OF THE INVENTION

As shown in the Figure, a detergent 10 in a quantity of approximately 40 cc is combined with water 12 in a quantity of approximately 110 cc, alcohol 14 in a quantity of approximately 20 cc, ammonia 16 in a quantity of approximately 10 cc and sodium carbonate or soda ash 18 in a quantity of approximately one-fourth teaspoon.

The ingredients of the formula are processed together in a mixture processing step 20 to produce the product 22. The product is applicable to the cork of a fishing rod handle to clean it and restore its original lustrous velvet finish.

The alcohol 14 is preferably rubbing alcohol.

The detergent preferably comprises alkyl benzene sulfonate or sodium dodecyl benzene sulfonate.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A cleaning formula comprising
a detergent in a quantity of 40 cc;
water in a quantity of 110 cc;
rubbing alcohol in a quantity of 20 cc;
ammonia in a quantity of 10 cc; and
sodium carbonate in a quantity of one-fourth teaspoon.

2. A formula as claimed in claim 1, wherein the detergent comprises alkyl benzene sulfonate.

3. A formula as claimed in claim 1, wherein the detergent comprises sodium dodecyl benzene sulfonate.

* * * * *